US006889979B2

(12) United States Patent
Blaha et al.

(10) Patent No.: US 6,889,979 B2
(45) Date of Patent: May 10, 2005

(54) CARD SHUFFLER

(75) Inventors: Ernst Blaha, Tullnerbach (AT); Peter Krenn, Neufeld (AT)

(73) Assignee: Shuffle Master GmbH & Co KG, Yienna (AT)

( * ) Notice: Subject to any disclaimer, the term of this patent is extended or adjusted under 35 U.S.C. 154(b) by 48 days.

(21) Appl. No.: 10/256,880

(22) Filed: Sep. 27, 2002

(65) Prior Publication Data

US 2003/0075866 A1 Apr. 24, 2003

(30) Foreign Application Priority Data

Oct. 19, 2001 (AT) ..... GM815/2001

(51) Int. Cl.[7] ..... A63F 12/00
(52) U.S. Cl. ..... 273/149 R
(58) Field of Search ..... 273/149 R, 149 P

(56) References Cited

U.S. PATENT DOCUMENTS

| | | | |
|---|---|---|---|
| 793,489 | A | 6/1905 | Williams |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,778,644 | A | 1/1957 | Stephenson |
| 2,937,739 | A | 5/1960 | Levy |
| 2,950,005 | A | 8/1960 | MacDonald |
| 3,147,978 | A | 9/1964 | Sjöstrand |
| 3,235,741 | A | 2/1966 | Plaisance |

(Continued)

FOREIGN PATENT DOCUMENTS

| | | |
|---|---|---|
| EP | 0 777 514 | 2/2000 |
| WO | WO 98/40136 | 9/1998 |
| WO | WO 99/52611 | 10/1999 |

OTHER PUBLICATIONS

CD Labeled "Shuffler Art." Attached to this 1449 is a spread sheet having the names of the individual files within the CD. There is a self–executing function on the CD so that, upon entering the Spread Sheet of content, individual items may be opened directly from the spread sheet according to the title of the document.

(Continued)

*Primary Examiner*—Benjamin Layno
(74) *Attorney, Agent, or Firm*—Mark A. Litman & Associates, P.A.

(57) ABSTRACT

A card shuffler with a drivable shuffling storage means (2') which is provided with compartments (69) for receiving cards (13) and which is associated with an input apparatus for inserting cards into the compartments (69) one by one and an output storage means which is spaced from the same for the shuffled cards, with the drive of the shuffling storage means (2'), the input apparatus and the output storage means being controlled by an electronic control system. In order to provide a card shuffler of the kind mentioned above which is capable of continually displaying the number of playing cards situated in the card shuffler and thus of providing the operator with the opportunity to have at all times certainty about the complete number of playing cards it is provided that the input apparatus (106) is provided with a draw-in zone (105) whose height corresponds substantially to the thickness of a card (13) and a first detection means (24) and a second detection means is provided which detects the cards (13) inserted into and removed from the shuffling storage means.

19 Claims, 5 Drawing Sheets

U.S. PATENT DOCUMENTS

| | | | | |
|---|---|---|---|---|
| 3,312,473 | A | 4/1967 | Friedman et al. | |
| 3,690,670 | A | 9/1972 | Cassady et al. | |
| 3,716,238 | A | 2/1973 | Porter | |
| 3,897,954 | A | 8/1975 | Erickson et al. | |
| 3,944,230 | A | 3/1976 | Fineman | |
| 4,159,581 | A | 7/1979 | Lichtenberg | |
| 4,232,861 | A | 11/1980 | Maul | |
| 4,361,393 | A | 11/1982 | Noto | |
| 4,368,972 | A | 1/1983 | Naramore | |
| 4,385,827 | A | 5/1983 | Naramore | |
| 4,397,469 | A | 8/1983 | Carter, III | |
| 4,497,488 | A | 2/1985 | Plevyak et al. | 273/149 R |
| 4,512,580 | A | 4/1985 | Matviak | |
| 4,513,969 | A | 4/1985 | Samsel, Jr. | |
| 4,515,367 | A | 5/1985 | Howard | |
| 4,534,562 | A | 8/1985 | Cuff et al. | |
| 4,566,782 | A | 1/1986 | Britt et al. | |
| 4,586,712 | A | 5/1986 | Lorber et al. | |
| 4,659,082 | A | 4/1987 | Greenberg | |
| 4,667,959 | A | 5/1987 | Pfeiffer et al. | 273/149 R |
| 4,741,524 | A | 5/1988 | Bromage | |
| 4,750,743 | A | 6/1988 | Nicoletti | |
| 4,770,421 | A | 9/1988 | Hoffman | |
| 4,807,884 | A | 2/1989 | Breeding | |
| 4,822,050 | A | 4/1989 | Normand et al. | |
| 4,832,342 | A | 5/1989 | Plevyak et al. | 273/149 R |
| 4,900,009 | A | 2/1990 | Kitahara et al. | |
| 4,969,648 | A | 11/1990 | Hollinger et al. | |
| 5,000,453 | A | 3/1991 | Stevens et al. | |
| 5,067,713 | A | 11/1991 | Soules et al. | |
| 5,121,921 | A | 6/1992 | Friedman et al. | |
| 5,199,710 | A | 4/1993 | Lamle | |
| 5,240,140 | A | 8/1993 | Huen | 221/13 |
| 5,261,667 | A | 11/1993 | Breeding | |
| 5,275,411 | A | 1/1994 | Breeding | |
| 5,288,081 | A | 2/1994 | Breeding | |
| 5,303,921 | A | 4/1994 | Breeding | |
| 5,356,145 | A | 10/1994 | Verschoor | |
| 5,374,061 | A | 12/1994 | Albrecht | |
| 5,382,024 | A | 1/1995 | Blaha | |
| 5,382,025 | A | 1/1995 | Sklansky et al. | |
| 5,390,910 | A | 2/1995 | Mandel et al. | |
| 5,431,399 | A | 7/1995 | Kelley | |
| 5,437,462 | A | 8/1995 | Breeding | |
| 5,584,483 | A | 12/1996 | Sines et al. | |
| 5,669,816 | A | 9/1997 | Garczynski et al. | |
| 5,676,372 | A | 10/1997 | Sines et al. | |
| 5,681,039 | A | 10/1997 | Miller | |
| 5,683,085 | A | 11/1997 | Johnson et al. | |
| 5,690,324 | A | 11/1997 | Otomo et al. | |
| 5,695,189 | A | 12/1997 | Breeding et al. | 273/149 R |
| 5,718,427 | A | 2/1998 | Cranford et al. | |
| 5,941,769 | A | 8/1999 | Order | |
| 5,944,310 | A | 8/1999 | Johnson et al. | 273/149 R |
| 5,989,122 | A | 11/1999 | Roblejo | |
| 6,019,368 | A | 2/2000 | Sines et al. | |
| 6,039,650 | A | 3/2000 | Hill | |
| 6,068,258 | A | 5/2000 | Breeding et al. | 273/149 R |
| 6,126,166 | A | 10/2000 | Lorson et al. | |
| 6,139,014 | A | 10/2000 | Breeding et al. | 273/149 R |
| 6,149,154 | A | 11/2000 | Grauzer et al. | |
| 6,165,072 | A | 12/2000 | Davis et al. | |
| 6,250,632 | B1 | 6/2001 | Albrecht | |
| 6,254,096 | B1 | 7/2001 | Grauzer et al. | 273/149 R |
| 6,267,248 | B1 | 7/2001 | Johnson et al. | 209/547 |
| 6,325,373 | B1 | 12/2001 | Breeding et al. | 273/149 R |
| 6,588,750 | B1 | 7/2003 | Grauzer et al. | |
| 6,588,751 | B1 | 7/2003 | Grauzer et al. | |
| 6,651,981 | B2 | 11/2003 | Grauzer et al. | |
| 6,651,982 | B2 | 11/2003 | Grauzer et al. | |
| 6,655,684 | B2 | 12/2003 | Grauzer et al. | |
| 6,659,460 | B2 * | 12/2003 | Blaha et al. | 273/149 R |
| 6,676,127 | B2 | 1/2004 | Johnson et al. | |
| 2003/0071413 | A1 * | 4/2003 | Blaha et al. | 273/149 R |

OTHER PUBLICATIONS

DVD Labeled "Luciano Decl. Ex. K." This is the videotaped live declaration of Mr. Luciano (see list of patents on the 1449 or of record in the file history) taken during preparation of litigation.

DVD labeled "Solberg Decl. Ex. C." This is the videotaped live declaration of Mr. Solberg, a witness for the defense, taken during preparation for litigation.

DVD labeled "Morrill Decl. Ex. A." This is videotaped live declaration of Mr. Robert Morrill, a lead trial counsel for the defense, taken during prepartion for litigation. He is describing the operation of Roblejo Prototype device. See Roblejo patent in 1449 or of record.

DVD labeled Exhibit 1. This is a DVD taken by Shuffle Mater personnel of the live operation of a CARD One–Two–Six ™ shuffler.

Specification of Australian Patent Application No.: 31577/95, filed Jan. 17, 1995, Applicants Rodney G. Johnson, et al., Title: Card Handling Apparatus.

Specification of Australian Patent Application No.: not listed, filed Aug. 15, 1994, Applicants Rodney G. Johnson, et al., Title: Card Handling Apparatus.

Scarne's Encyclopedia of Games by John Scarne, 1973, "Super Contract Bridge", p. 153.

* cited by examiner

CARD SHUFFLER

The invention relates to a card shuffler according to the preamble of claim 1.

Card shufflers have been known for a long time, e.g. from U.S. Pat. No. 4,586,712. The card shuffling apparatus disclosed there comprises an input apparatus, an output storage means and an interposed shuffling storage means. The cards are inserted via a narrow gap into the shuffling storage means. Sensors (photoelectric cells) check whether the respective compartments of the shuffling storage means are free for receiving cards, with the status of each compartment being stored in an electronic register.

From EP 0 777 514 B1 a card shuffling apparatus is known which conveys the cards from an input apparatus to a shuffling storage means and from there to the output storage means. The introduction into the shuffling storage means occurs via guide elements which press the currently drawn card against draw-in rollers. Sensors detect whether cards are conveyed out of the input apparatus into the shuffling container and from there out again in order to enable the control of the respective motors for driving the draw-in rollers and the shuffling storage means.

All said known card shufflers relate to technical solutions for shuffling playing cards. No emphasis is placed on a continual verification of the number of used playing cards situated in the card shuffler.

It is the object of the present invention to avoid this disadvantage and to provide a card shuffler of the kind mentioned above which is capable of displaying continuously the number of playing cards situated in the card shuffler or in the shuffling storage means and to thus give the operator the opportunity to have certainty at all times about the complete number of playing cards.

The method in accordance with the invention offers an error-free possibility to detect the number of the cards situated in the shuffling storage means. The unauthorized and unnoticed removal of cards from a game is thus no longer possible.

The introduction of a card into the shuffling storage means and the removal of the cards from the shuffling storage means can be detected in a contactless manner.

The invention is now explained in closer detail by reference to the enclosed drawing, wherein:

FIG. 1 schematically shows a card shuffler in accordance with the invention with removed cover;

Figure 1:
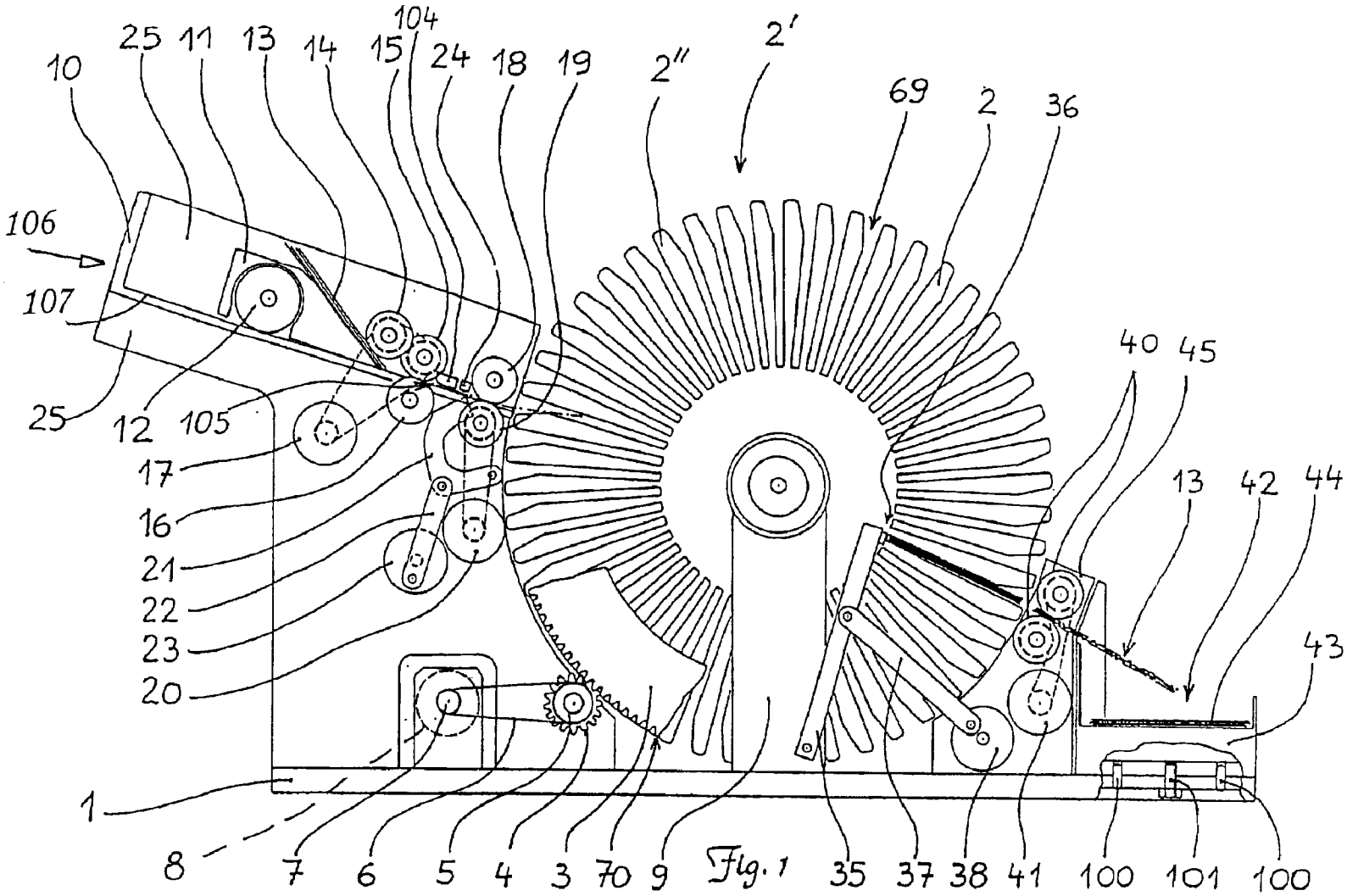

A shuffling storage means 2' is situated on a console formed of two legs 9 which is arranged on a base plate 1, which shuffling means is formed by a rotatably held drum 2. Said drum 2 is connected via spacers 62 (FIG. 6) with two disks 3. The flanges 2" of the drum 2 are provided with compartment-like slots 69 which are provided for receiving cards 13.

Said disks 3 are each provided with a circular toothing 70. The shuffling storage means 2' can be driven via a pinion 4 and a toothed pulley 5 which is rigidly connected with the same, with both being jointly held rotatably in plate bars 25, and a toothed belt 6 via a second toothed pulley 7 and a motor 8. Said motor 8 is driven via a random-check generator and optionally moves the shuffling storage means 2' in mutually opposite directions, so that an oscillating movement of the shuffling storage means 2' can occur.

Figure 2:
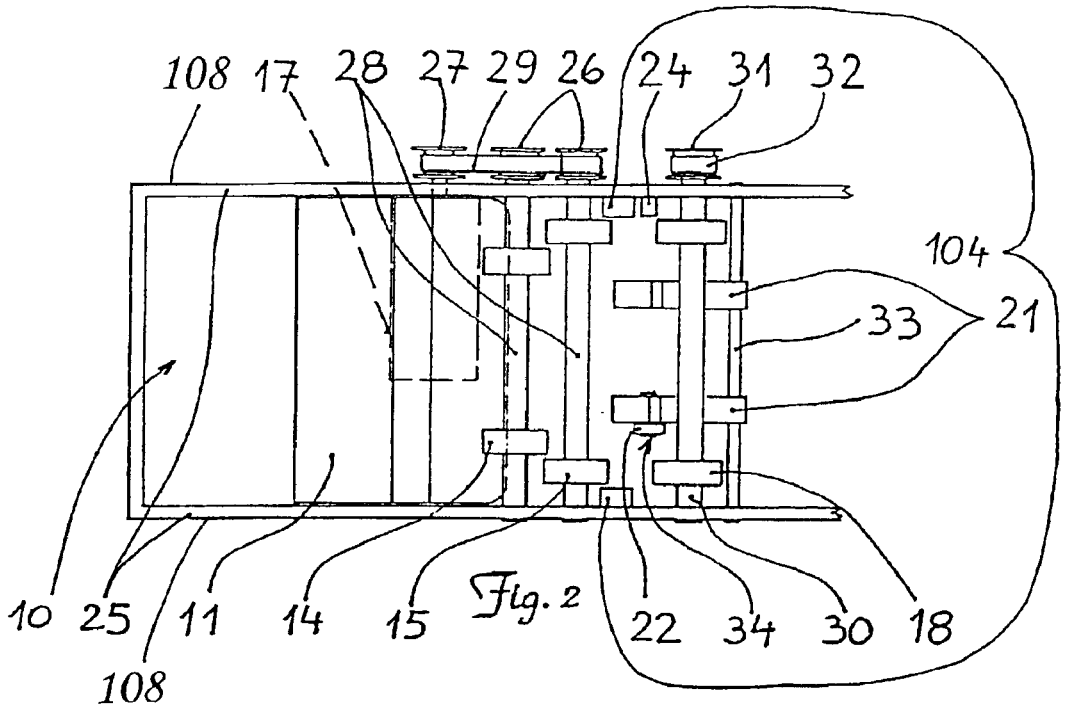
FIG. 2 shows a top view of the input apparatus.

A storage container 10 for the played cards 13 is provided which is part of an input apparatus 106. It comprises a wedge 11 which rolls off by way of a roller 12 which is arranged rotatably in the same on an inclined floor 107 of the storage container 10 against two elastic rollers 14 (FIG. 2). The two rollers 14 are held rotatably on a common shaft 28 in the two plate bars 25 and can be driven jointly with the rollers 15 via two pulleys 26, a toothed belt 29 as well as a pulley 27 via a motor 17. Two rollers 16 touch the two rollers 15 at the circumference, so that they are co-rotated by the surface friction.

Two bridges 104 each form with the floor 107 of the storage container 10 a gap-like draw-in zone which is substantially the thickness of a playing card 13 to guarantee that only one card at a time is conveyed to the shuffling storage means 2'. A sensor 24 is provided as a preferably optical sensor for recognizing the respectively moved card 13. Every card which is moved from the storage container 10 to the shuffling storage means 2' must therefore at first pass the gap-like draw-in zone one after the other and then the sensor 24, with the sensor 24 being covered or triggered at first by the playing card 13 entering the sensor zone and being uncovered again after the passage of the card 13. The electronic control, preferably a microprocessor, which is provided downstream of the sensor, therefore registers the change from covered to uncovered sensor as a passing playing card 13, as long as the electronic control does not recognize a jam in the card path.

The electronic control adds the cards 13 inserted one by one into the individual compartments 69 of the shuffling storage means 2' to an electronic register and subtracts the cards 13 taken from individual compartments according to their number from the electronic register with the goal of keeping a continual inventory on the playing cards 13 situated in the device.

A jam in the card path is recognized when the rollers 14, 15 or 19 are blocked and thus the motors 17 and 20 show an increased current consumption. Alternatively, a jam can be recognized when the playing card 13 covers the sensor 24 for a longer period than corresponds to the conveying speed of rollers 14 and 15 with respect to the conveyance of a playing card 13 or when the sensor remains uncovered for a longer period although the electronic control triggers the drive of the rollers 14 and 15 and the playing cards 13 are located in the storage container 10, which fact can also be verified through a sensor (not shown) in floor 107.

The roller pair 19 and the pair of rollers 18 which touches the other pair on the circumference and which are each situated on a shaft 30 can be driven in the same manner by motor 23 as described above.

The two levers 21 are used for fully pushing the respectively moved card 13 into a compartment 69 of the shuffling storage means 2' and can be driven in an oscillating fashion via the rod 22, which is swivelably connected with one of the levers 21 by the shaft 34, through an eccentric disk 23 seated on a motor.

Two variants of output storage means 42, 42' are provided for the shuffled cards 13 which can be fastened optionally on the base plate 1 and can be exchanged easily for each other.

A receiving means is provided which comprises two alignment pins 100 which are inserted into the base plate 1 and on which a card storage means 42, 42' for the shuffled cards can be inserted which is provided in the zone of its floor with respective bores 102. In order to fix the respective card storage means 42, 42' a screw 101 is provided which engages in a threaded bore 103 of the card storage means 42, 42'.

Figure 3:
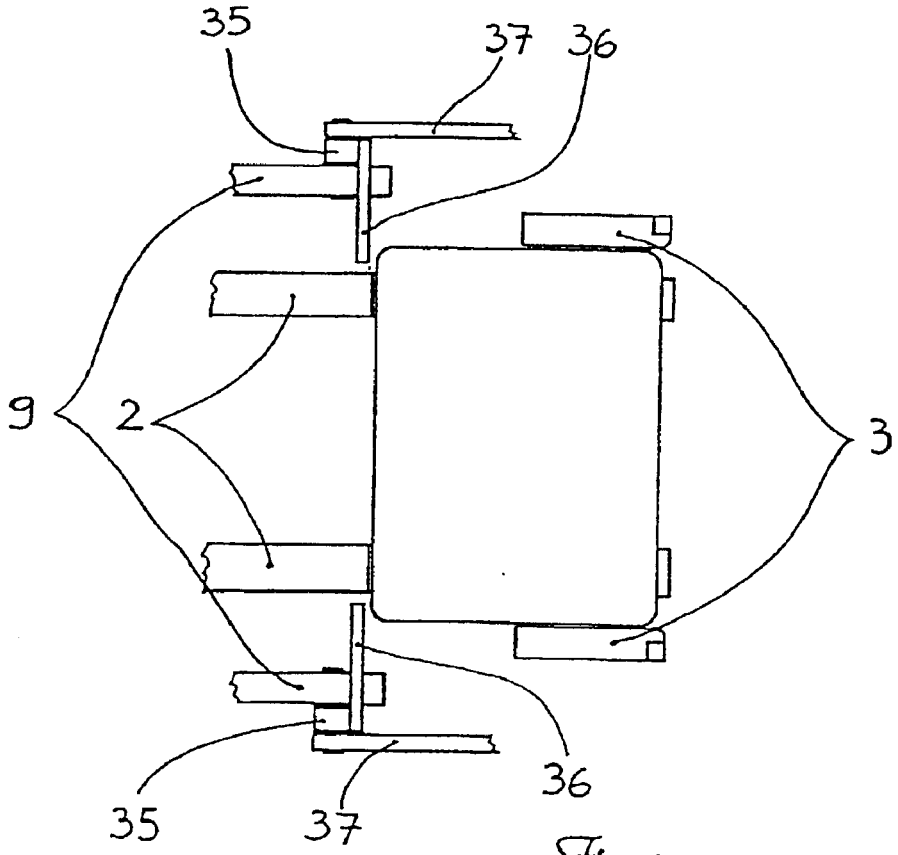
FIG. 3 shows a detail of a withdrawing apparatus.

The output of the cards 13 from the compartments 69 to a card storage means 42, 42' occurs by means of two swiveling arms 35 which are swivelably held in the two legs 9 and are oscillatingly drivable via lever 37 and via an eccentric disk 38 seated on a motor. Said two swiveling arms 35 each carry at their upper end an inwardly projecting rail 36 (FIG. 3) which grasps the cards 13 situated in a compartment 69 and conveys them to a nip line of two clamping rollers 40. Said clamping rollers 40 are held in the plate bars 45 and are simultaneously drivable by a motor 41.

The clamping rollers 40 convey the respectively moved cards 13 to the card storage means 42 as shown in FIG. 1 for the shuffled cards for the purpose of a stack-wise removal of the cards 13, or to a card storage means 42' for a removal of shuffled cards 13 one after the other.

A card storage means 42 is formed substantially by a U-shaped table 43 in which the cards 13 are deposited on a stack 44. The cards can be upwardly removed from said table 43 by the croupier in an optionally stack-wise manner.

Figure 4:
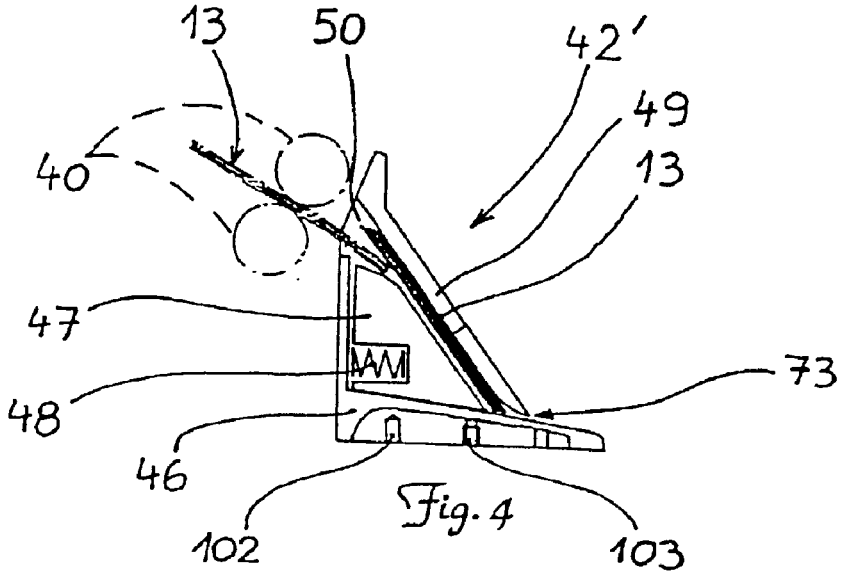
FIG. 4 shows an output storage means in which the shuffled cards are output.
Figure 4A:
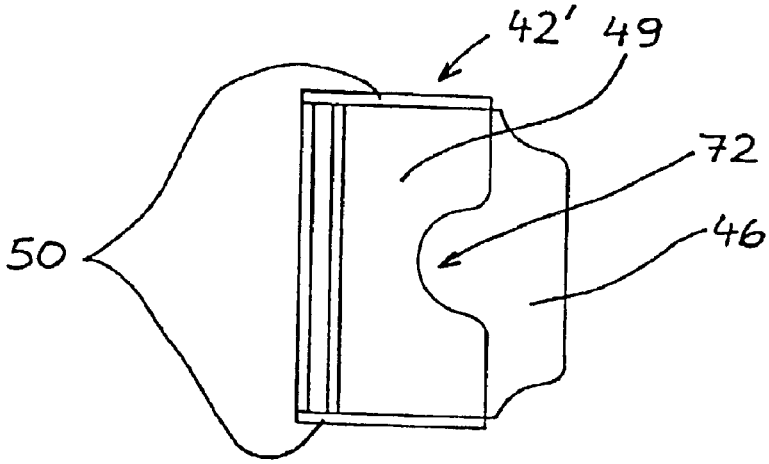
FIG. 4A shows a top view of the output storage means according to FIG. 4.

The card storage means 42' according to FIGS. 4 and 4A is provided for removing cards 13 one by one. The cards 13 emerging from the nip line of the clamping rollers 40 enter the card storage means 42' via a gap 50, which storage means is delimited by a downwardly extending oblique wall 49 and a spring-loaded shoe 47. The cards 13, which may also optionally be several of them at the same time, are pushed between the shoe 47 and the wall 49 or the cards 13 already situated in the card storage means 42', with the shoe 47 being pushed back against the force of the spring 48. The shoe 47 slides over the inclined plane of an L-shaped basic body 46. A gap 73 remains between the lower edge of the wall 49 and the L-shaped basic body 46 through which the cards 13 can be withdrawn one by one.

As is shown in FIG. 4A, the inclined wall 49 is provided at its lower edge with a centrally arranged recess 72 which facilitates the withdrawal of individual cards 13. The card storage means 42' is delimited at the side by walls 50. The shuffled cards 13 can be removed one by one by the croupier in such a way that the front one of the playing cards 13 is grasped by fingers through the recess 72 in wall 49 and is pulled out through the gap 73.

Figure 5:
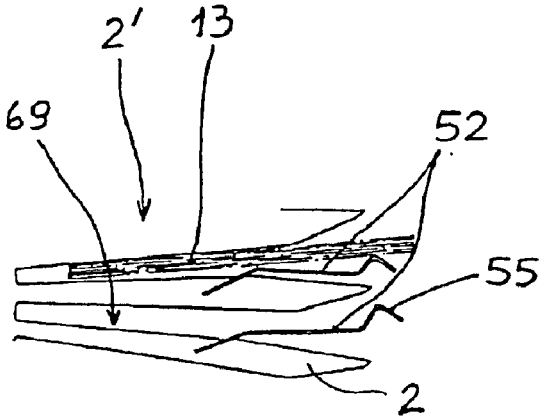
FIGS. 5, 5A show details of variants in the arrangement of compartments of the shuffling storage means.
Figure 5A:
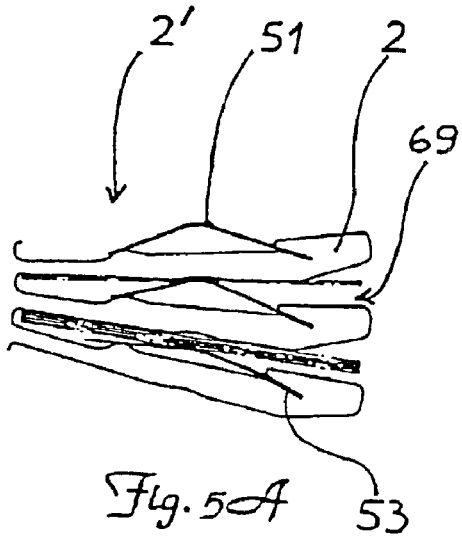

As is shown in FIGS. 5 and 5A, springs 51, 52 are arranged in the compartments 69 of the shuffling storage means 2' which produce a clamping of the card(s) 13 pushed into the respective compartment 69. A spring 52 is provided with a bend-off 55 which covers the radially outer openings of the compartments 69 and prevents securely that cards 13 are not ejected outwardly through centrifugal force during the rotation of the shuffling storage means 2'.

The springs 51 according to FIG. 5A are arranged as bent or offset leaf springs and are inserted in a slot 53 of the one wall of the compartment 69 and press against the respective opposite wall of the compartment 69. The card pushed into the respective compartment 69 is therefore clamped between said spring 51 and the opposite wall of the compartment 69 and held in this way in the respective compartment 69.

The output of the cards 13 of a compartment 69 occurs in such a way that the card 13 or a package of up to nine cards 13 for example is ejected. This occurs by means of the swiveling arms 35 and the rails 36, as has already been described above. The springs 51, 52 are deformed during the ejection of the card(s) 13.

Figure 6:
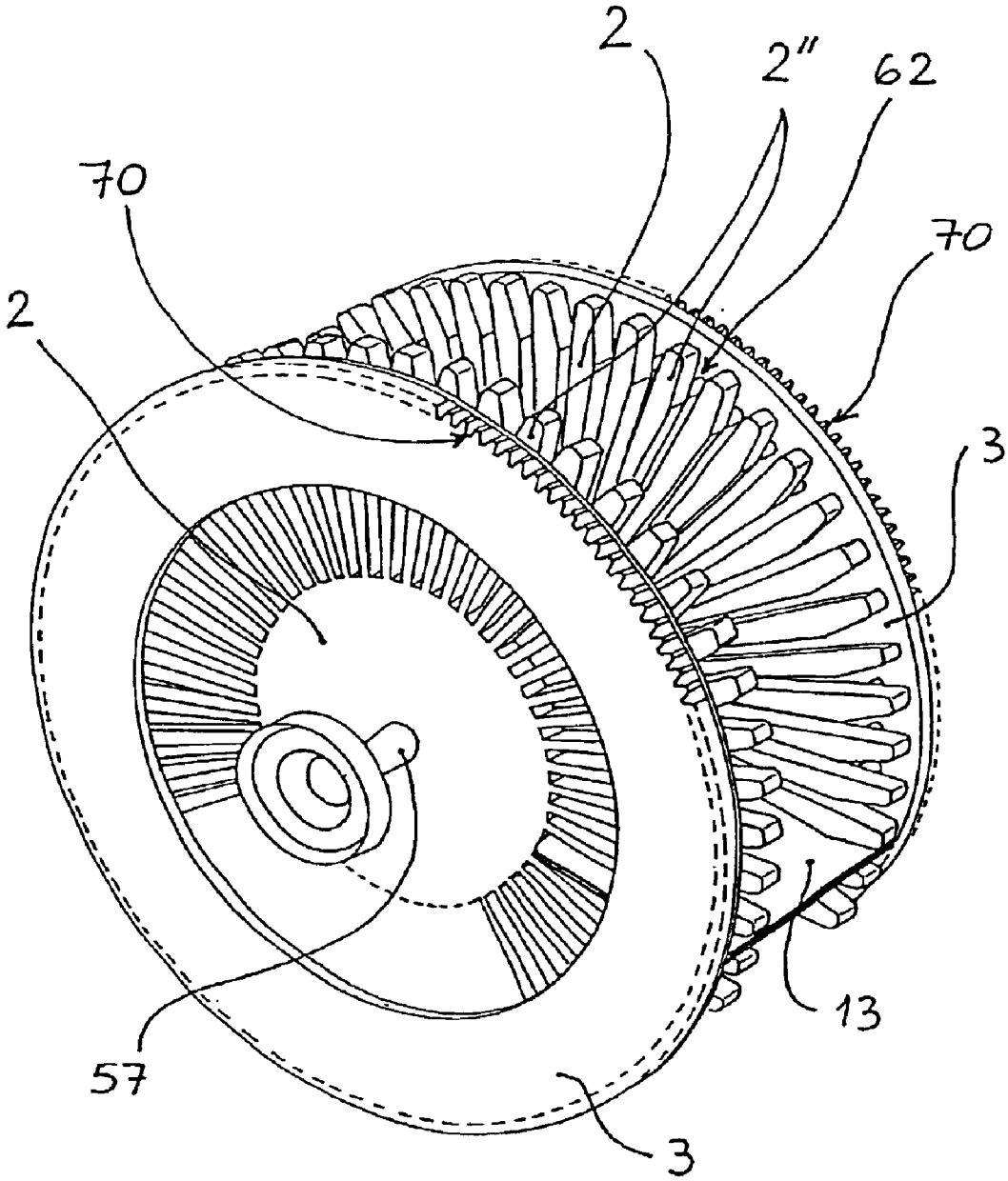
FIG. 6 shows an axonometric representation of the shuffling storage means.

As is shown in FIGS. 1 and 6, the drum 2 rests with its axle journals 57 in receiving means of the legs 9 and can be removed or lifted off from the same easily. Since the compartments 69 are provided with springs 51, 52, the cards 13 can remain in their compartments when the drum 2 is removed.

Figure 7:
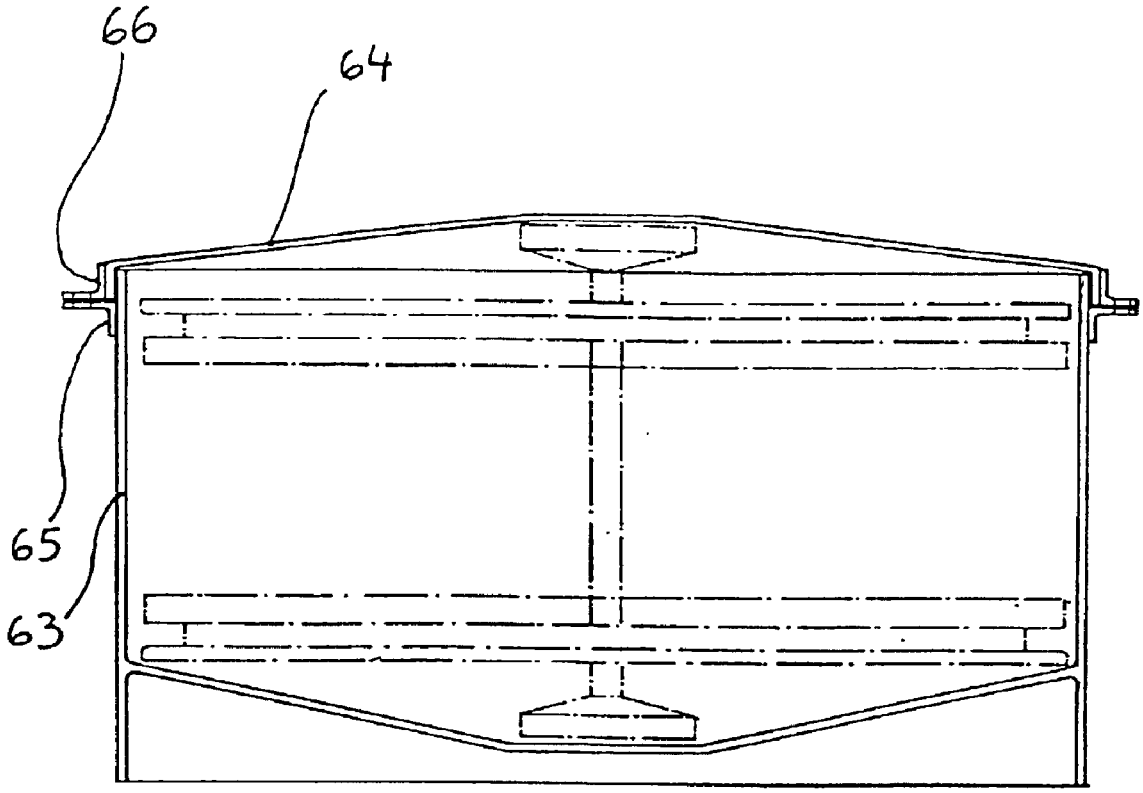
FIG. 7 shows a security container with a shuffling storage means.

The drum 2 can be placed in a security container 63 (FIG. 7) and can be transported with the same, with the container 63 being closeable by a lid 64. For this purpose flanges 65, 66 are fastened to the container 63 and the lid 64. This allows connecting and locking the container 63 with the lid 64 in a manipulation-proof way.

In order to continually check the number of cards 13 situated in the shuffling storage means 2', it is necessary to detect the number of all cards 13 which were placed in the compartments 69 of the shuffling storage means 2'. At the same time it is necessary to detect the number of cards 13 which were removed from the compartments 69. For this purpose it must be ensured at first that the cards 13 are inserted into the compartments 69 one by one. It is provided for this purpose in accordance with one embodiment of the invention that the cards 13 are guided through a gap-like drawn-in zone 105 of defined thickness, with the thickness corresponding substantially to the thickness of a card 13. The gap-like draw-in zone 105 is defined in the present embodiment by two bridges 104 that project inwardly from the side walls 108 of the storage container 10 and are separated from the floor 107 of the storage container 10 a distance substantially equal to the thickness of a card 13. It is understood that instead of the two bridges 104 it is also possible to provide a continuous bridge which connects the two side walls 108 of the storage container 10.

After the card 13 has passed said draw-in zone 105, a sensor 24, preferably an optical sensor, is provided which detects the passage of a card 13. After the passage of a card 13 an internal register of an electronic memory of the electronic control is increased by the value of one. At the same time the electronic control system stores the number of the compartment 69 in which the card 13 was inserted. The allocation of numbers to individual compartments 69 also occurs by the electronic control system upon activating the card shuffler.

When cards 13 are removed from the compartments 69 of the shuffling storage means 2', this occurs via the withdrawing apparatus 35, 37, 38, as described above. In the present embodiment, a compartment 69 can only be emptied completely. Since the electronic control system is informed at all times about the number of cards 13 per compartment (=card value) it is thus easy to determine how many cards are taken from the shuffling storage means 2'.

A sensor detects actuation of the withdrawing apparatus 35, 37 that ejects all cards from a compartment as a group.

The sum total of the cards 13 situated in the shuffling storage means 2' is thus obtained in a simple manner by the addition of the cards 13 inserted in the shuffling storage means 2' and the subtraction of the cards 13 removed therefrom.

It is understood that the method can also be applied to a card shuffler which allows the removal of individual cards 13 from the shuffling storage means 2', i.e. an entire compartment 69 is therefore not completely emptied. In this case it is not necessary that the electronic control system stores the number of cards 13 per compartment 69, because after the removal of the individual cards 13 from the shuffling storage means 2' the same can be moved past a sensor again. As a result, the electronic control system is informed at all times about the cards 13 individually supplied to and removed from the shuffling storage means 2', as a result of which the sum total of the cards 13 situated in the shuffling storage means 2' is always known.

What is claimed is:

1. A method for performing an inventory of cards in an electronically controlled card shuffler, with cards of an unshuffled stack being output to an output stage in a random sequence, the method comprising:

forwarding cards from the unshuffled stack into individual compartments of the card shuffler;

detecting the passage of each card forwarded to the compartments;

counting the number of cards forwarded to the compartments to determine the number of cards within each of the compartments;

ejecting cards from the compartments into the output stage; and subtracting the number of cards ejected from the compartments from the number of cards forwarded to the compartments to identify the total number of cards still in the compartments, wherein subtracting the number of cards ejected from the compartments comprises subtracting the number of cards ejected from a compartment as a single group from the number of cards forwarded to the compartments, wherein detecting the number of cards ejected from the compartments comprises detecting actuation of an ejecting device that ejects all cards from a compartment as a group.

2. The method of claim 1 wherein forwarding cards into individual compartments comprises transporting cards from the unshuffled stack into individual compartments such that multiple cards reside in at least one compartment.

3. The method of claim 1 wherein counting the number of cards forwarded to the compartments comprises incrementing a memory by a value of one for each card forwarded to a compartment.

4. The method of claim 1 wherein detecting the passage of each card forwarded to the compartments comprises optically sensing cards passing an optical sensor.

5. The method of claim 1 wherein the compartments are radially arranged around a rotating drum, the method further comprising:

randomly rotating the drum such that a sequence of cards entering the compartments is different from a sequence of cards delivered to the output stage.

6. The method of claim 5 wherein randomly rotating the drum comprises controlling a motor, connected to the drum, whose movement is controlled by a random generator.

7. The method of claim 5 wherein randomly rotating the drum comprises intermittently rotating the drum I opposite directions while receiving cards and ejecting cards.

8. The method of claim 1 wherein the compartments are part of a movable storage device, the method further comprising:

randomly rotating the storage device such that a sequence of cards entering the compartments is different from a sequence of cards delivered to the output stage.

9. The method of claim 1 further comprising randomly selecting a compartment for receiving a card from the unshuffled stack.

10. The method of claim 1 wherein forwarding cards comprises transporting cards through a gap that substantially corresponds to the thickness of a card to ensure only one card at a time is forwarded to a compartment.

11. The method of claim 1 further comprising:

assigning a number to each compartment;

identifying a number of cards stored in each compartment.

12. An electronically controlled card shuffler comprising:

an input stage for receiving an unshuffled stack of cards;

a movable storage device having compartments for receiving cards;

a transporter for forwarding cards, one at a time, from the unshuffled stack to the compartments;

an ejector for ejecting cards from the compartments into an output stage such that a sequence of cards entering the compartments is different from a sequence of cards delivered to the output stage; and a detector for detecting the passage of each card forwarded to the compartments, detecting a number of cards ejected into the output stage, and determining the total number of cards still in the compartments, wherein the ejector ejects all cards from a compartment as a single group, the detector further detecting the number of cards within each of the compartments and subtracting the number of cards ejected from the compartments as a single group from the number of cards forwarded to the compartments, wherein the detector comprises a sensor for detecting actuation of the ejector that ejects all cards from a compartment as a group.

13. The shuffler of claim 12 wherein the transporter forwards cards from the unshuffled stack into the compartments such that multiple cards reside in at least one compartment.

14. The shuffler of claim 12 wherein the detector comprises an optical sensor for detecting the passage of cards across the sensor.

15. The shuffler of claim 12 wherein the detector comprises an electronic memory for incrementing a count of cards when the cards are forwarded to the compartments, and decrementing the count of cards when cards are ejected from the compartments.

16. The shuffler of claim 12 wherein the compartments are radially arranged around a rotating drum.

17. The shuffler of claim 16 further comprising a motor, connected to the drum, for randomly rotating the drum such that a sequence of cards entering the compartments is different from a sequence of cards delivered to the output stage.

18. The shuffler of claim 12 further comprising an electronic controller for randomly selecting a compartment for receiving a card from the unshuffled stack.

19. The shuffler of claim 12 further comprising opposing structures forming a gap, the gap substantially corresponding to a thickness of a card, the gap being in a path of cards forwarded to the compartments to ensure only one card at a time is forwarded to a compartment.

* * * * *